United States Patent [19]

Vezirian

[11] Patent Number: 5,040,623

[45] Date of Patent: Aug. 20, 1991

[54] CONTROLLED TRUE GEOMETRY ROCK BIT WITH ONE PIECE BODY

[76] Inventor: Edward Vezirian, P.O. Box 215, Beaumont, Calif. 92223

[21] Appl. No.: 575,354

[22] Filed: Aug. 30, 1990

[51] Int. Cl.[5] ..... E21B 10/10

[52] U.S. Cl. ..... 175/354; 175/375

[58] Field of Search ..... 175/331, 339, 354, 375

[56] References Cited

U.S. PATENT DOCUMENTS

| | | | |
|---|---|---|---|
| 1,388,424 | 8/1921 | George | 175/348 |
| 1,636,668 | 7/1927 | Reed | 175/366 |
| 2,061,657 | 11/1936 | Howard | 175/348 |
| 2,147,927 | 2/1939 | Scott | 175/375 |
| 3,239,431 | 3/1966 | Knapp | 175/331 |
| 3,850,256 | 11/1974 | McQueen | 175/356 |
| 4,145,094 | 3/1979 | Vezirian | 175/375 |
| 4,158,973 | 6/1979 | Schumacher, Jr. et al. | 175/375 |
| 4,258,807 | 3/1981 | Fischer et al. | 175/375 |
| 4,335,794 | 6/1982 | Goodfellow | 175/366 |
| 4,610,318 | 9/1986 | Goodfellow | 175/339 |

*Primary Examiner*—William P. Neuder

[57] ABSTRACT

A rotary cone rock bit featuring a reproducible geometry and a one piece body is disclosed. Individual journal members, supporting rotary cutting cones, have upwardly extending structural shanks which are radially oriented and installed into downwardly directed individual hubs formed by the structural body of the rock bit. The shanks are subsequently secured as installed within the hubs. The primary controls over bit geometry comprise the radial orientation of the individual journal member, and the radial location of the individual hubs relative to the vertical bit body centerline.

5 Claims, 1 Drawing Sheet

CONTROLLED TRUE GEOMETRY ROCK BIT WITH ONE PIECE BODY

BACKGROUND OF THE INVENTION

1. Field of the Invention

This invention pertains to the structure of rotary cone rock bits. More specifically, this invention relates to the manner in which rock cutting cones are rotatively supported, located, and oriented with respect to a predetermined and controlled rock-cutting geometry.

2. Description of the Prior Art

This discussion is limited to rock bits having a plurality of rotating toothed cutters which are generally conical in form. The conical rock cutters are rotatively borne upon downwardly and inwardly directed cantilevered journal shafts which depend from a structural body. The upper portion of the body is threaded for attachment to the lower end of a drill line made of pipe. The bit body also serves the function of a terminal pipe fitting to control and route a fluid flow from the drill line pipe to exit through the plurality of fluid nozzles housed therein.

In use, the drill line pipe is rotated while forcing the rock bit into the earth. The rock cutter cones, with their vertices directed toward the vertical centerline of the drill bit, roll about the vertical centerline of the drill bit as the rock cutting teeth are forced into the geologic formation to crush and fracture rock. Fluid pumped down the drill line and through the nozzles serves both to dissipate the heat of drilling, and to flush rock cuttings from the drilling zone and upward to the earths surface through the annular space between the bore hole wall and the drill line pipe.

To permit assembly of the rock cutter cones upon their respective journal shafts, the structural body of the rock bit is conventionally made in separate longitudinal segments, called "Legs", each leg incorporating one journal shaft. The segments are welded into an integral unit after being assembled with the cutters. After welding, the body is threaded for attachment to the lower end of the drill line.

Inventors in the art have long recognized the advantages in production of a rotary rock bit designed with a "one-piece" body structure, yet the segmented form has remained the standard of the industry.

U.S. Pat. No. 1,388,424 issued to George in 1921 teaches the use of a unitary bit body having four conical cutters with axes nearly vertical, two being convergent and two being divergent. The cones and journals are shown integral, rotatively supported in bushings housed within the bit body, and fixed by threaded means. Unfortunately the cutting geometry of this design appears to be very non-aggressive.

Clarence Reed, a prolific inventor in the art, describes in U.S. Pat. No. 1,636,666 and more particularly in U.S. Pat. No. 1,692,793 a two cone rock bit of conventional cutting geometry featuring a one piece rock bit body. Individual journal shafts depend from vertical posts which are mechanically drawn into bores within the bit body by threaded means, after assembly of the rotary cutters.

Swift and Dalldorf were granted U.S. Pat. No. 1,726,049 on a unique rock bit having three cutters with vertical axes mounted in a straight line. The cylindrical cutters carried helical teeth which intermeshed to provide mutual cleaning and synchronous rotation. The cutters depend from a one piece bit body.

U.S. Pat. No. 2,061,657 by Howard, assigned to GLOBE OIL TOOLS COMPANY taught a design in which two cutters depend from a one piece bit body. Near vertical journal shafts demonstrate strong negative camber. The upper stator end of each journal member is drawn into a matching locking taper within the body and secured, in the production model, by a nut on a threaded extension of the journal member. The patent drawing, however, depicts use of a flat drive key with a locking taper. The cutting geometry was made effective by the use of the negative camber. The Howard patent was applied for in May of 1933, but before it came to issue in November of 1936, the well known three cone bit of current commerce, U.S. Pat. No. 1,983,316 by Scott et al, assigned to HUGHES TOOL COMPANY was issued, and has since pre-empted the marketplace.

An English inventor, Lanchester, in U.S. Pat. No. 2,648,526 teaches the use of a one piece bit body in a three cone rock bit. The independent journal shafts depend from cylindrical shanks which are threadingly drawn and secured into vertically converging bores within the bit body.

A novel cutting structure using three interleaving cutters with integral journal shafts having vertically converging axes rotatively supported by roller bearings within the one piece bit body, is described in U.S. Pat. No. 2,915,291 by Gulfelt.

The two latter designs seem never to have been successfully commercialized.

With the advent of ELECTRON BEAM WELDING, a number of patents have been issued directed to the use of this process in the production of rock bit designs having one-piece bit bodies U.S. Pat. Nos. 3,850,256 McQueen, 4,145,094 Vezirian, 4,158,973 Schumacher, 4,187,743 Thomas, and 4,256,194 Varel, are all illustrative of this trend. Although all of these efforts relied upon conventional prior art rotary cone cutting geometries, commercial use has not been seen. U.S. Pat. No. 4,209,124 by Baur, however, is directed to a fixture for electron beam welding a conventional segmented bit body together and is widely practiced.

U.S. Pat. No. 4,335,794 by Goodfellow shows a one-piece bit body with an open cylindrical "Pot" formed within the lower end. Cones are mounted on journals which depend from short "Legs" which are configured to fill the pot annularly, leaving a tapered bore at the center which is then filled with a tapered plug, in turn secured by a central bolt.

Generally, in a rotary cone rock bit, the centerlines of the individual rotary cones do not intersect the vertical centerline of the bit. By design, the cone centerline is displaced from the bit centerline by a certain small distance called the "offset". The offset is designed to "lead", meaning that the vertex of the cone advances, or "leads", about the bit center during normal drilling rotation, rather than retreating or "lagging". Offset introduces a small radial motion to the cutting tooth while it is in contact with the rock, increasing the cutting action of the tooth. Larger offsets are for use in relatively softer rock formations.

The individual "leg" of the conventional rotary cone rock bit is finished with radially extending flat surfaces which meet 120 degrees apart at the vertical bit centerline. These surfaces are mated to like surfaces on adjacent legs at assembly. The integral journal bearing shaft, formed by the lower end of the leg, is assembled with a rotary cone and then the legs are welded together along these vertically and radially eXtending flat faying surfaces to form the structure of the rock bit.

At assembly, a gage ring having an inside diameter equal to the diameter that the bit is intended to bore is placed around the cones. The cones are made to contact the inside diameter of the gage ring prior to welding the legs together, to insure that the bit is of correct size. Due to variability of parts and manufacturing tolerances, the fit to the gage ring may require adjusting. It is common practice to shift the legs with respect to one another along their faying surfaces to bring about that adjustment. This is done to the detriment of the built in offset dimension. Too much offset may cause premature failure of cutting teeth, while too little offset can reduce the rate of penetration of the rock bit.

SUMMARY OF THE INVENTION

An object of this invention is to provide a controllable true geometry for the location and orientation of the rotary rock cutting cones, in a rotary rock bit.

Another object of this invention is to provide a viable design for a rotary rock bit, using an unwelded one piece structural body.

This invention is directed to the use of a one-piece rock bit body supporting individual journal shaft members which are secured thereto. Each individual journal shaft member is assembled to its associated rotary rock cutter prior to being assembled to the finished structural bit body.

The structural one piece rock bit body is roughly cylindrical in form, haVing a roughly flat lower end.

The upper end of the structural rock bit body forms a pipe nipple characterized by a large tapered thread extending upwardly from a dry-seal flange. The thread and flange are specified by THE AMERICAN PETROLEUM INSTITUTE, (A.P.I.), and controlled by master gages held by the U.S. Bureau of Standards, and the American Petroleum Institute. The thread permits attachment of the bit to the drill line pipe, and the flange is depended upon to transfer the drilling weight or pressure from the drill line pipe to the bit body, and to prevent leakage of drilling fluid from within. The threaded nipple defines a vertically oriented fluid inlet port which is in communication with one or more fluid outlet ports which are formed on the flattened lower end of the bit body.

At least one port for the delivery of drilling fluid is provided in the flat bottom of the bit body. Generally one such port is provided adjacent to each cutter cone employed.

Journal mounting bosses are located on the flat bottom surface of the one-piece structural body of the rock bit, a predetermined distance from the rock bit centerline, and having a predetermined orientation relative to the rook bit centerline. A mechanical key, for example a dowel entering both the rock bit body and the journal member, may be used to establish the orientation of the journal member with respect to the rock bit body at assembly. Alternatively, matching keyways may be formed in interfacing surfaces of both the journal and the rock bit body to house a hard key at assembly.

The flat bottom surface of the rock bit body forms one journal mounting boss for each rock cutting cone to be carried by the rock bit. Two or more cones may be used, however, the most commonly used configuration has a total of three cones.

A male journal mounting boss could, for example, be formed as a downwardly extending structural mounting post. On the other hand, a female journal mounting boss would be an internal socket precisely formed by and within the flat bottom surface of the structural bit body.

An individual journal member comprises a structural body having an upwardly directed mounting feature of form and gender complementary to that of the journal mounting boss, and adapted for securing to the journal mounting boss. A cantilevered journal shaft extends downward and radially inward from the structural body of the individual journal member. The journal shaft is adapted to rotatively support a rock cutting cone.

A male mounting feature would be an upwardly extending structural mounting post. A female mounting feature would be a precisely formed internal socket, opening upward.

Each individual journal member is assembled with a rotary rock cutting cone. Each preassembled rock cutter cone and individual journal member combination, and a corresponding journal mounting boss are telescoped together at assembly. Mechanical keying is provided by design to insure proper radial orientation of the journal member in relation to the vertical centerline of the structural bit body, thereby controlling the offset dimension.

The location, orientation, and geometry of features occurring repetitively in a one-piece rock bit body are more controllable and are more reliably reproduced from rock bit to rock bit in the instance of a one piece rock bit body design than in the welded prior art designs, a goal long sought in the industry and referred to as "true geometry".

The elimination of welding between body segments, also eliminates the production thereby of interfacial separations, voids, cracks, pin holes, or pits within the weld. Such weld defects may permit erosion by abrasive fluid intrusion, and the ultimate early failure of the structure by that process.

The practice of securing structural members by threaded means is generally avoided in rock bit manufacture as a weakness in design.

The securing of the mounting features of the individual journal members to their respective bosses could be accomplished by heavy force fitting, if welding and threading are to be avoided, however, differential thermal shrink fitting is the preferred method in that it may be accomplished without attendant damage to the parts so assembled.

An advantage of this invention is that the A.P.I. thread can be produced in a conventional lathe without the problems caused by having to cross massive weld beads having non homogeneous inclusions or voids within.

Another advantage of this invention is increased safety to the machine operator in cutting the A.P.I. thread without having to cross lateral weld beads with the cutting tool.

Another advantage of this invention is that the A.P.I. thread is formed on the one-piece body prior to rock bit assembly. Prior art rock bits are threaded as a final step where a miss cut thread could scrap the finished bit.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
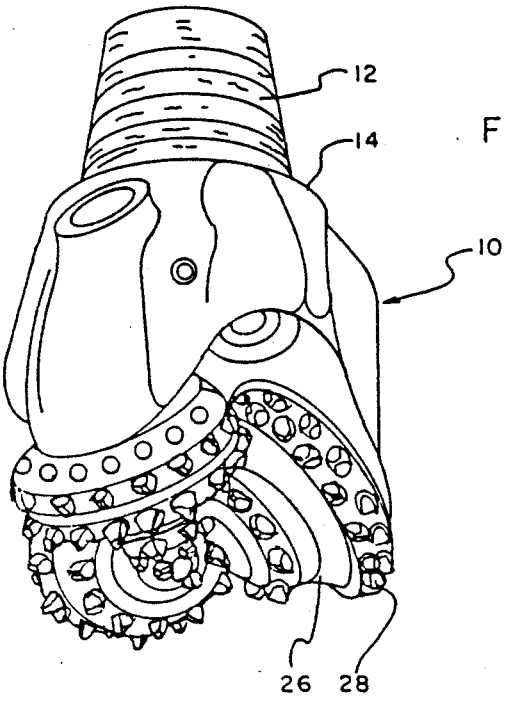
FIG. 1. Is a perspective view of a typical three cone rotary rock bit.

A typical three cone rotary rock bit is depicted in FIG. 1. The structural bit body is generally indicated as 10. Upper end threaded nipple 12 extends upward from dry seal flange 14. Rotary rock cutting cones 26 carry inserted hard cutting teeth 28.

Figure 2:
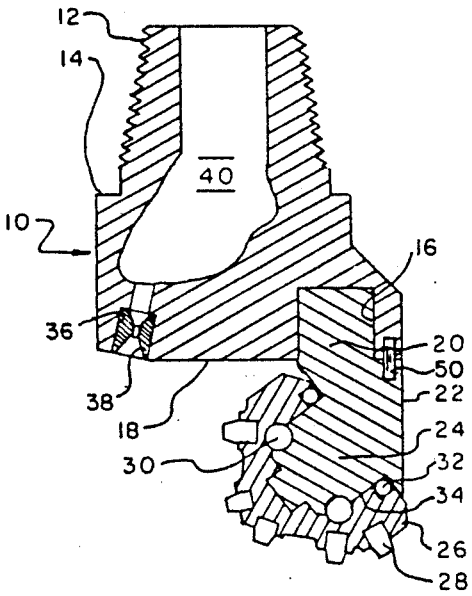
FIG. 2. Is a cross section through an assembled rock bit of the preferred embodiment, clearly showing one form of the journal member to boss interface.

The preferred embodiment of the instant invention is pictured in FIG. 2, a cross-sectional view of a rotary rock bit. The structural rock bit body is generally indicated as 10. Upper end of the substantially cylindrical bit body is a tapered threaded pipe nipple 12 extending upwardly from dry seal flange 14. Pipe nipple 12 is concentrically formed about central bore 40 which conducts drilling fluid to fluid exit nozzle 38, held secure in fluid port 36.

Journal mounting boss 16, a precision bore, is formed by substantially flat bottom end 18 of structural bit body 10, adapted for interference fitting therein of mounting shank 20 of individual journal member 22. Orientation of journal member 22 with respect to bit body 10 is assured by dowel 50 which enters both journal member 22 and bit body 10, mechanically keying the journal member 22 in predetermined position. Cantilevered downward from individual journal member 22, journal shaft 24 extends radially inward and angularly downward rotatively supporting rock cutting cone 26, carrying inserted hard cutting teeth 28. Rock cutting cone 26 is axially retained on journal shaft 24 by bearing balls 30, and is grease lubricated relative to journal shaft 24. Elastomeric O-ring seal 32 retains lubricating grease and excludes drilling fluid from the bearing space 34.

Fluid port 36 housing nozzle 38 in flat bottom end 18 of bit body 10, directs drilling mud downward and radially outward.

The central bore 40 of upper threaded nipple 12 is in communication with fluid port 36 and nozzle 38 to conduct drilling fluid toward the drilling zone.

Figure 3:
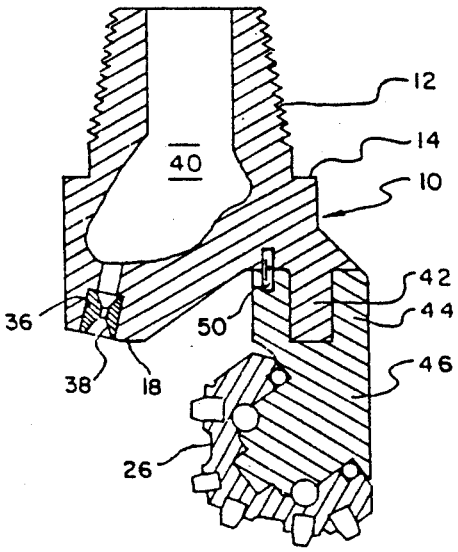
FIG. 3. Is a cross section through an assembled bit body of the preferred embodiment, showing an alternate form of the journal member to boss interface.

FIG. 3 illustrates another embodiment of the instant invention showing an alternate form of the journal member to bit body connection. The bit body, generally indicated as 10, is threaded at the upper end nipple 12. The flat bottom end 18 forms fluid port 36, in communication with central fluid bore 40. Fluid port 36 houses fluid exit nozzle 38. Flat bottom 18 of bit body 10 forms journal mounting boss 42. Mounting feature 44 of journal member 46 is interference fitted to journal mounting boss 42. Dowel 50 enters both journal member 46 and bit body 10 at assembly mechanically keying proper orientation of journal member 46 with respect to bit body 10. Journal member 46, in turn, supports rock cutting cone 26.

Interference fitting is usually done by the use of heavy force, as in an arbor press. In the interests of maximizing retention strength and avoiding damage to, or distortion of components, or interfacial shearing in the pressing process, differential thermal shrink fitting is preferred. In any event, the choice does involve the selection of steel used, and the heat treating specifications to be followed. The amount of interference obtainable is dependent upon the size of the components involved, and the extent of the temperature differential employed. The female member must be relatively hot, and the temperature of that member must not exceed the drawing or aging temperature used in heat treating that member. The journal member and cone sub-assembly generally contains temperature sensitive materials that must also be considered. Greases and elastomeric seals can, of course, be damaged in prior art bits by the process of welding the segments together. Assembly by the thermal method is relatively easy, but must be done quickly. Repositioning of mal-assembled units cannot be accomplished, thus it is recommended that parts be keyed to each other to insure their relative positions after assembly. Radial timing of the individual journal member relative to its associated boss is required to establish the desired gage diameter of the rock bit, the actual offset dimension, and thus the predictable true geometry.

Although interference fitting is the preferred method of securing the individual journal members to the one piece structural rock bit body, and is thusly described herein, it should be realized that other methods may be used without departing from the intention or scope of this specification. Other such methods would of course include threaded means and such metallurgical procedures as welding or brazing, or other mechanical lock.

It will of course be realized that various modifications can be made in the design and operation of the present invention without departing from the spirit thereof. Thus, while the principal construction and mode of operation of the invention have been explained in what is now considered to represent its best embodiments, which have been illustrated and described, it should be understood that within the scope of the appended claims, the invention may be practiced other than as specifically illustrated and described.

I claim:

1. A rotary cone rock bit comprising:

a one piece structural rock bit body, said rock bit body having a substantially cylindrical form with a threaded end extending upwardly from a flange, and having a substantially flat lower end, said flat lower end forming a plurality of journal mounting bosses, a vertically oriented fluid entry port formed by said threaded end of said rock bit body, said fluid entry port being in communication with at least one fluid exit port formed by said flat lower end of said rock bit body, one individual journal member for each said journal mounting boss, said journal member further comprising a central structural body, a downwardly and inwardly extending cantilevered journal bearing shaft, and, an upwardly directed mounting feature, said mounting feature being complimentary to said journal mounting boss, a rotary rock cutting cone rotatively supported by said cantilevered journal bearing shaft of each said journal bearing member, means to mechanically key each such individual journal member to said rock bit body to define a predetermined positional orientation therebetween at assembly, and, said mounting feature of each said individual journal member being assembled and secured to one said journal mounting boss.

2. A rotary cone rock bit comprising: a one piece structural rock bit body, said rock bit body having a substantially cylindrical form with a threaded end extending upwardly from a flange and having a substantially flat lower end, said flat lower end forming a plurality of journal mounting sockets, a vertically oriented fluid entry port formed by said threaded end of said rock bit body, said fluid entry port being in communication with at least one fluid exit port, said fluid exit port being formed by said flat lower end of said rock bit body, one individual journal member for each said journal mounting socket, said journal member further comprising a central structural body, a downwardly and inwardly extending cantilevered journal bearing shaft, and, an upwardly extending structural mounting post, said mounting post being complementary to said journal mounting socket, means to mechanical key said individual journal member to said rock bit body so as to define a predetermined positional orientation therebetween, a rotary rock cutting cone rotatively supported by said cantilevered journal bearing shaft of each said journal bearing member, and, said structural mounting post of each said individual journal member being assembled and secured into one said journal mounting socket in said rock bit body.

3. The invention as described in claim 2 wherein each said individual journal member is secured into one journal mounting socket of said rock bit body by interference fitting.

4. A rotary cone rock bit comprising:

a one piece structural bit body, said rock bit body having a substantially cylindrical form with a threaded end extending upwardly from a flange and having a substantially flat lower end, said flat lower end forming a plurality of downwardly extending structural journal mounting posts, a vertically oriented fluid entry port formed by said threaded end of said rock bit body, said fluid entry port being in communication with at least one fluid exit port formed by said flat lower end of said rock bit body, one individual journal member for each said journal mounting post, said journal member further comprising a central structural body, a downwardly and inwardly extending cantilevered journal bearing shaft, and, an upwardly directed mounting socket, said socket being complementary to said journal mounting post, means to mechanical key said individual journal member to said rock bit body so as to define a predetermined positional orientation therebetween, a rotary rock cutting cone rotatively supported by said cantilevered journal bearing shaft of each said individual journal member, and, said mounting socket of each said individual journal member being assembled and secured onto one said journal mounting post.

5. The invention as described in claim 4 wherein each said individual journal member is secured onto one journal mounting post of said rock bit body by interference fitting.

* * * * *